US006880607B2

(12) United States Patent
Marocco

(10) Patent No.: US 6,880,607 B2
(45) **Date of Patent: *Apr. 19, 2005**

(54) BLIND WITH REINFORCED HEAD RAIL

(75) Inventor: Norbert Marocco, Woodbridge (CA)

(73) Assignee: Shade-O-Matic Limited, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/462,245

(22) Filed: Jun. 16, 2003

(65) Prior Publication Data

US 2003/0205336 A1 Nov. 6, 2003

Related U.S. Application Data

(63) Continuation-in-part of application No. 10/054,140, filed on Jan. 22, 2002, now Pat. No. 6,615,895.

(51) Int. Cl.[7] ..... E06B 9/38
(52) U.S. Cl. ..... 160/173 R; 160/178.1 R
(58) Field of Search ..... 160/173 R, 173 V, 160/166.1, 168.1 R, 168.1 V, 172 R, 178.1 R, 178.1 V, 176.1 R, 177 R

(56) References Cited

U.S. PATENT DOCUMENTS 2,651,358 A * 9/1953 Lorentzen ..... 160/178.1 R
2,670,532 A * 3/1954 Lorentzen ..... 29/271
2,673,608 A * 3/1954 Nelson ..... 160/178.1 R
2,787,322 A * 4/1957 Jacobson et al. ..... 248/251
4,441,540 A * 4/1984 Tsuhako ..... 160/168.1 R
4,518,025 A * 5/1985 Judkins ..... 160/84.04
5,348,068 A * 9/1994 Elsenheimer et al. . 160/176.1 R
5,520,235 A * 5/1996 Coleman ..... 160/89
6,164,362 A * 12/2000 Yang ..... 160/84.04
6,263,945 B1 * 7/2001 Nien ..... 160/173 R
6,615,895 B1 * 9/2003 Marocco ..... 160/173 R

* cited by examiner

*Primary Examiner*—David Purol
(74) *Attorney, Agent, or Firm*—Ohlandt, Greeley, Ruggiero, Perle, L.L.P.

(57) ABSTRACT

An extruded plastic head rail for a blind of the type having blind elements suspended from such head rail, in which the head rail is reinforced to prevent sagging of the head rail under the load of the blind elements, and in which the head rail is suitable for trimming to length by a point of sale trim cutting apparatus, the head rail having a head rail extrusion extruded from plastic material and, a reinforcement member in the head rail, the reinforcement member extending along at least a median portion of length of the head rail, the reinforcement member supporting the head rail and the blind elements, to prevent bending of the head rail under the load of the blind elements.

21 Claims, 9 Drawing Sheets

BLIND WITH REINFORCED HEAD RAIL

This application is a continuation in part of U.S. application Ser. No. 10/054,140 filed on Jan. 22, 2002 now U.S. Pat. No. 6,615,895.

FIELD OF THE INVENTION

The invention relates to blinds of the kind having a head rail, and a plurality of blind slats suspended from the head rail, and in particular to such a blind in which the head rail is formed of plastics material, such as extruded polyvinyl chloride material, and is reinforced along its interior, with reinforcement members, preferably, though not exclusively, with metal reinforcements. More particularly this invention relates to a plug disposed in the end of the head rail to capture the reinforcement member between the plug and head rail and inhibit movement of the reinforcement member when cutting through said head rail, reinforcement member and plug.

BACKGROUND OF THE INVENTION

Blinds having a head rail and blind slats suspended from the head rail are well known. Such blinds include "venetian" blinds in which the slats run from side to side, horizontally, and also vertical blinds in which the slats hang vertically down from trollies carried in the head rail.

For many years such head rails have been made of metal. Usually they have been formed in the shape of a rectangular U-shaped channel, with the blind operating and control mechanism located in the channel.

In recent years however customers have been seeking a more economical form of blind. Head rails for less expensive blinds are now commonly made of extruded plastics material, such as polyvinyl chloride materials. Such materials have their advantages such as low cost and freedom from maintenance and the like. However customers are always seeking for new and different visual effects in blinds. In one case it has become the practice to make the blind slats themselves of extruded plastic materials. These are both less expensive than metal blind slats, and also provide a more solid look than conventional thin metallic blind slats.

However the use of such thicker plastic blind slats carries with it the penalty of greater weight. In fact for a given size of window the use of thicker plastic slats, can increase the weight to the point where they will impose bending stresses on the extruded plastic head rail, and it will bow downwardly in the centre.

This is both unsightly, and may also cause malfunction of the blind control mechanism located within the head rail.

The problem could be overcome by using a conventional metallic head rail, but this would increase the cost, and might also affect the appearance of the blind.

Another factor in the marketing of such blinds is that is becoming the custom to market these blinds through department stores. Blinds are supplied to the store in standard widths. A customer will measure the actual window or door opening in which he wishes to erect a blind. He will then place his order in the store. The sales clerk will then select a blind having a width greater than that required by the customer.

He will then trim the ends of the blind head rail and the blind slats (and the bottom rail if provided) so as to fit the customer's requirement.

Various machines are available for trimming blinds. Some use cutting blades. Others use actual profiled cutting dies, especially for cutting metallic head rails.

Examples of such in store point of sale blind trimming machines can be seen in U.S. Pat. Nos. 5,806,394; 6,196,099; 6,178,857; 6,089,134; all of which are owned by Shade-O-Matic Llimited, also the owner of the present application.

However, where the blinds have a plastic head rail, and extruded plastic slats, and a bottom rail in some cases, it is preferable to cut them with a saw. The plastic is softer and at the same time thicker than the metal used for conventional head rails. Thus in the case of a blind having a plastic head rail, and plastic blind slats, the length of the cutting stroke required to cut a given number of plastic blind slats is increased compared with cutting the same number of metal blind slats. Cutting such plastic slats with a knife edge requires considerable effort. It also tends to damage the plastic at the ends of the slats. Because the stroke required to cut the stack of thicker plastic blind slats is much longer than the stroke required to cut thin metal blinds slats, then either the manual effort required to make the cut must increase, or the leverage available in the cutting machine must be increased. Neither is desirable or practical. It is in fact found that the use of a saw, typically a rotary saw disc will provide a quick clean cut through the relatively softer plastic blind slats, and also the plastic head rail, with a minimum of physical effort.

This also has the added advantage that the head rail, usually a U-shaped channel, can be cut cleanly with a saw, without the need for supporting it in a special die. Such rotary saw cut down equipment is now becoming widely available in retail stores, rendering it possible to such stores to meet public demand for low cost blinds, trimmed to size on demand, in the store.

However, if the plastic head rail is not capable of supporting the weight of the blind slats then it should preferably be given some kind of reinforcement such that it will be effective to prevent sagging under the weight of the plastic blind slats.

However, the reinforcement must be such that it does not prevent the head rail from being cut down or trimmed in the in store trimming apparatus, of which the saw cutting equipment now available is one example, in the retail stores.

BRIEF SUMMARY OF THE INVENTION

An extruded plastic head rail for a blind of the type having blind elements suspended from such head rail, in which the head rail is reinforced to prevent sagging of the head rail under the load of the blind elements, and in which the head rail is suitable for trimming to length by point of sale trim cutting apparatus, the head rail having a head rail extrusion extruded from plastic material and, a reinforcement member attached to the head rail, the reinforcement member extending along at least a median portion of length of the head rail, the reinforcement member supporting the head rail and the blind elements, to prevent bending of the head rail under the load of the blind elements.

The invention further seeks to provide an extruded plastic head rail for a blind wherein said head rail defines a front side wall and a rear side wall and a bottom wall.

The invention further seeks to provide an extruded plastic head rail for a blind wherein said reinforcement member comprises a three sided channel of reinforcement material.

The invention further seeks to provide an extruded plastic head rail for a blind wherein said reinforcement material is metallic.

The invention further seeks to provide an extruded plastic head rail for a blind wherein said reinforcement material is rigid strip of plastic material.

The invention further seeks to provide an extruded plastic head rail for a blind wherein said reinforcement member is a generally three sided channel fitting within said head rail.

The invention further seeks to provide an extruded plastic head rail for a blind wherein said reinforcement member comprises a planar strip of metallic material.

The invention further seeks to provide an extruded plastic head rail for a blind wherein the head rail has at least a front wall and a bottom wall, and reinforcement attached thereto.

The invention further provides for a plug member disposed in the ends of said head rail so as to capture the reinforcement member between the plug member and head rail and inhibit movement of the reinforcement member when cutting through said head rail, reinforcement member and plug.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As mentioned above the invention relates to blinds in which the head rail supports blind slats, and in which the head rail is made of plastics material and is reinforced to carry the weight of the blind slats. Typically the blinds are "venetian" blinds with a plurality of horizontal blind slats. However the invention does not exclude to possibility of its use with vertical blinds, in which the blind slats hang vertically down from the head rail.

Figure 1:
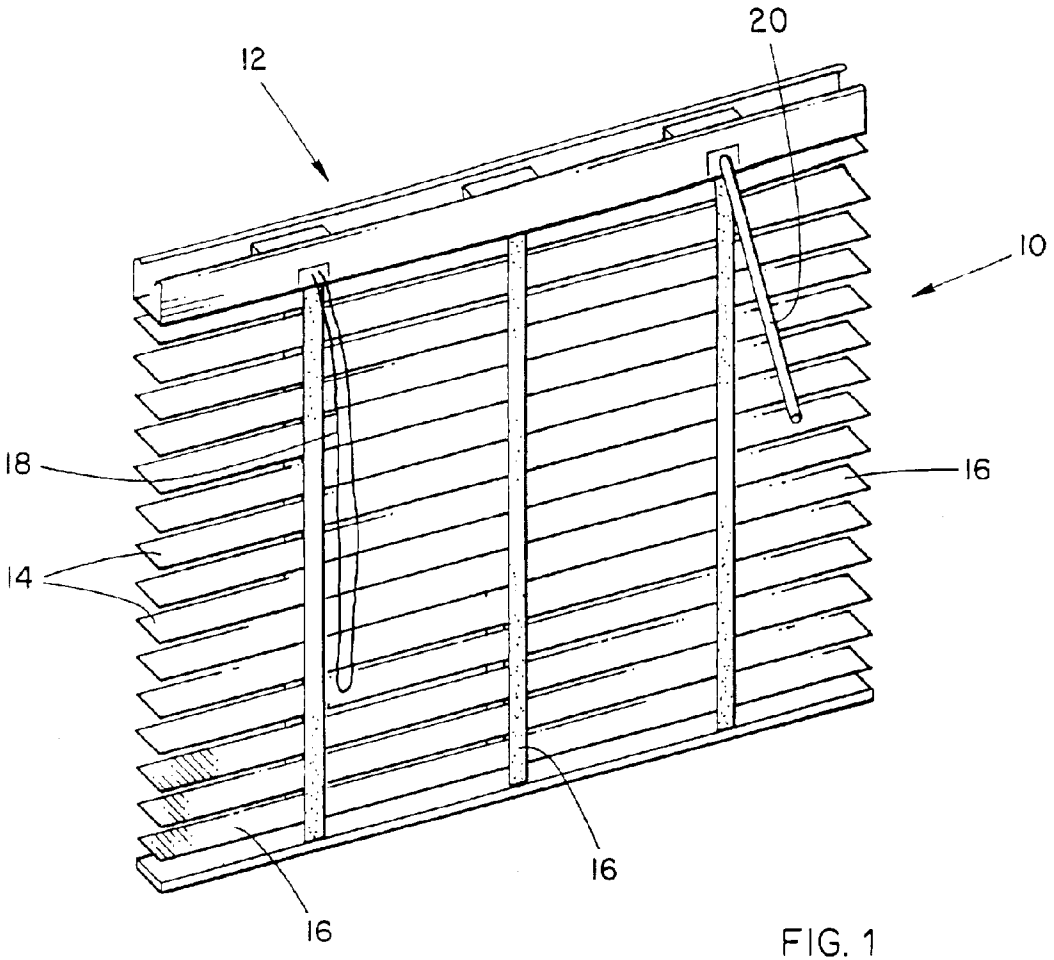
FIG. 1 is a general perspective of a typical venetian blind, for the purposes of illustrating the invention.

Thus, purely for purpose of explanation and without limitation FIG. 1 illustrates a typical "venetian" blind 10. It has a head rail 12, and blind elements, in this case slats 14, attached on ladder tapes 16. A tilt control rod 18, and raise cords 20 provide means by which the blind slats can be tilted open or closed, or raised or lowered, in known manner. In many cases it may also have a bottom rail, also of extruded plastic material. The blind controls 18 and 20 are all mounted in the head rail. The head rail 12 in this embodiment, is shown in the form a three sided U-shaped channel, with the open side facing upwardly. As has been explained there is a demand for more economical blinds, in which the blind elements or slats are made of extruded plastic and are relatively thick and heavy. In these lower cost blinds it is desirable to make both the head rail and the blind slats from extruded plastic. This renders the blind easier to trim to length at a point of sale using an in store trim cutting apparatus. However it is found that where the blind slats are heavy, because for example they are made of relatively thick extruded solid plastic material, or even of wood in some cases, the plastic head rail will bend and sag in the middle. This will be unsightly and cause malfunction of the blind controls located in the head rail.

While blind slats are illustrated it will be understood that the invention is not solely limited to blinds having blind slats. The term blind elements as used herein is intended to include both blind slats and other forms of blind designs, whether having slats, fabric, or any other type of window covering.

Accordingly the invention makes provision for the reinforcement of the plastic head rail so as to give it increased strength and enable it to resist bending stresses.

Figure 2:
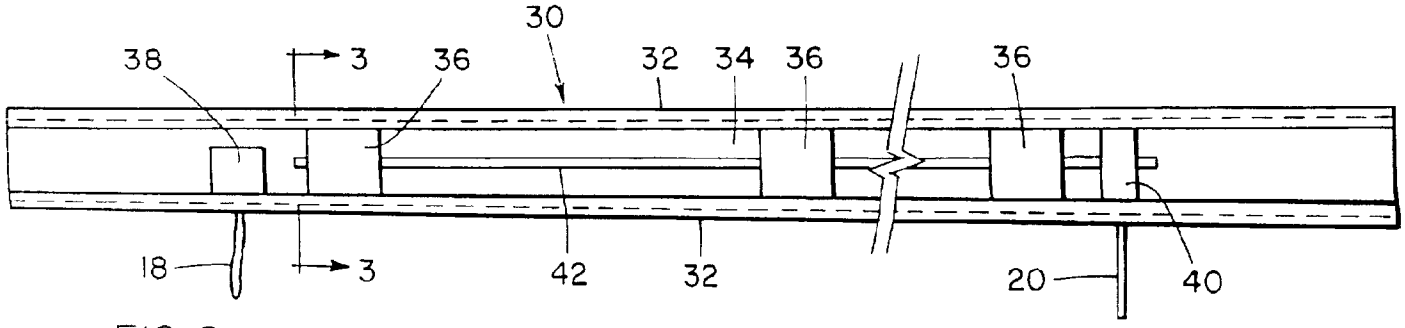
FIG. 2 is a top plan view of a head rail illustrating one embodiment of the invention.
Figure 3:
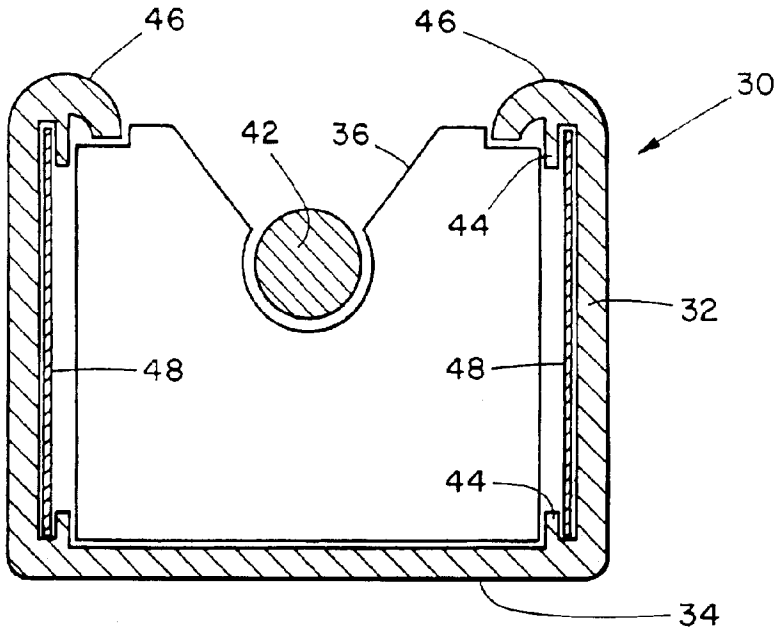
FIG. 3 is a section along line 3—3 of FIG. 2.

One embodiment of the invention is illustrated in FIGS. 2, and 3.

A head rail 30 is illustrated, formed of plastic material, such as polyvinyl chloride extruded, in this embodiment, in a channel shape of a head rail. It defines side walls 32—32, and a web 34. The upper side is open upwardly. Blind controls, consisting of tape drums 36, and a raise cord lock 38 and a tilt control 40 are located in head rail 30. A transmission rod 42 extends through the tilt control 40 and drums 36.

All of this is well known in the art and requires no description.

As shown in FIG. 3 the head rail is formed on its interior with upper and lower ridges 44, which extend parallel to side walls 32 but are spaced inwardly.

Upper arcuate ribs 46 are formed along the upper edges of side walls 32, and face inwardly partially closing the open upper side of the channel of head rail 30.

In order to reinforce the head rail, in this embodiment, two planar reinforcement strips 48 are secured within the head rail 30. Strips 48 are secured in place by sliding between ridges 44 and side walls 32 (FIG. 3). The reinforcement strips 48 may typically be formed of a suitable metal. However the invention does not exclude the use of non-metallic reinforcement strips, such as might be made of some more rigid form of plastic material, for example fibre reinforced resin materials or the like.

Where the reinforcement is of a material, or a metal, which is suitable for in store trim cutting for example by saw cutting trim apparatus, for example, aluminum, then the reinforcement strips can extend from end to end of the head rail. When trimming the head rail down to size, at the point of sale, in the retail store, the sales clerk will simply place one end of the head rail, and the blind slats and the bottom rail (if provided) in a saw cut down machine (not shown) and make a cut, and then reverse the blind and make a similar trim cut at the other end of the components, using the saw for example. Such a saw will easily cut through both the plastic head rail and the softer metal reinforcement, as well as through the bind slats and bottom rail.

Figure 4:
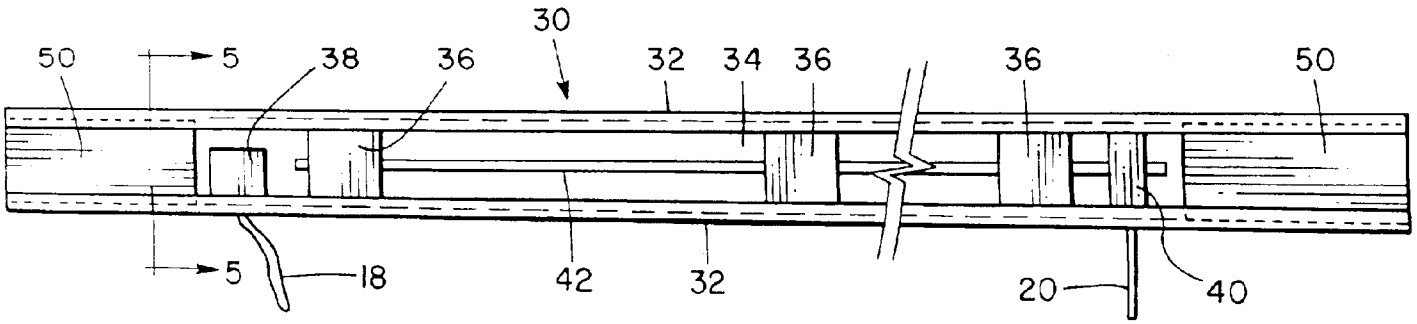
FIG. 4 is a top plan view of a head rail illustrating another embodiment of the invention.

However, in some cases the metallic strip or strips will be of harder metal such as steel. In these cases also, it is necessary to permit a sales clerk to trim the ends of the head rail, as well as the blind slats and bottom rail, in this embodiment of the invention the harder metallic strips 48 will extend only over a median portion of the length of the head rail 30, as shown in phantom in FIG. 4.

The features of the plastic head rail 30 are the same as those in FIGS. 2 and 3, and have the same reference numbers.

However, as explained above the metal reinforcement strips 48 will be shorter than the length of the head rail 30, in this embodiment, so as to permit trimming at each end, and will terminate short of each end of the head rail 30.

Figure 5:
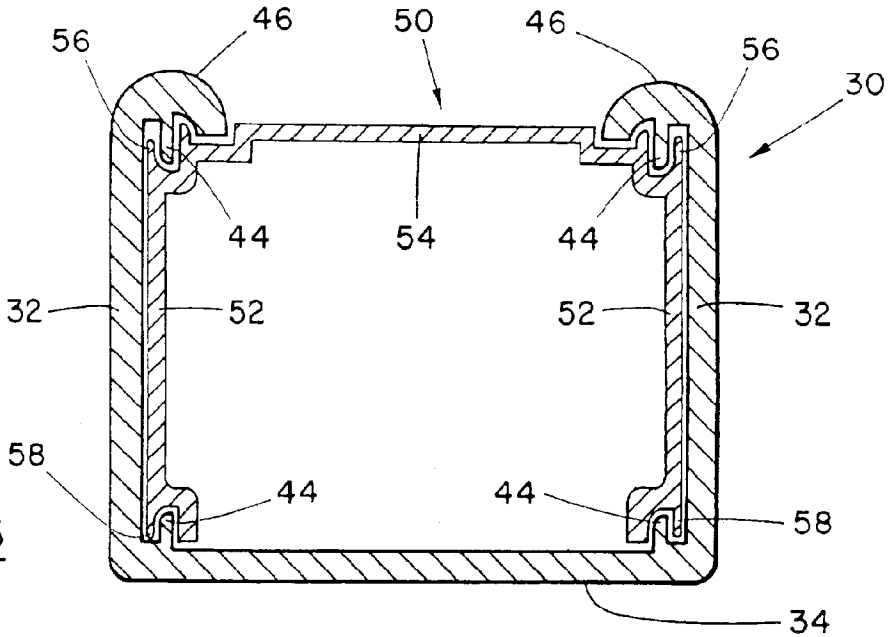
FIG. 5 is a section along line 5—5 of FIG. 4.
Figure 6:
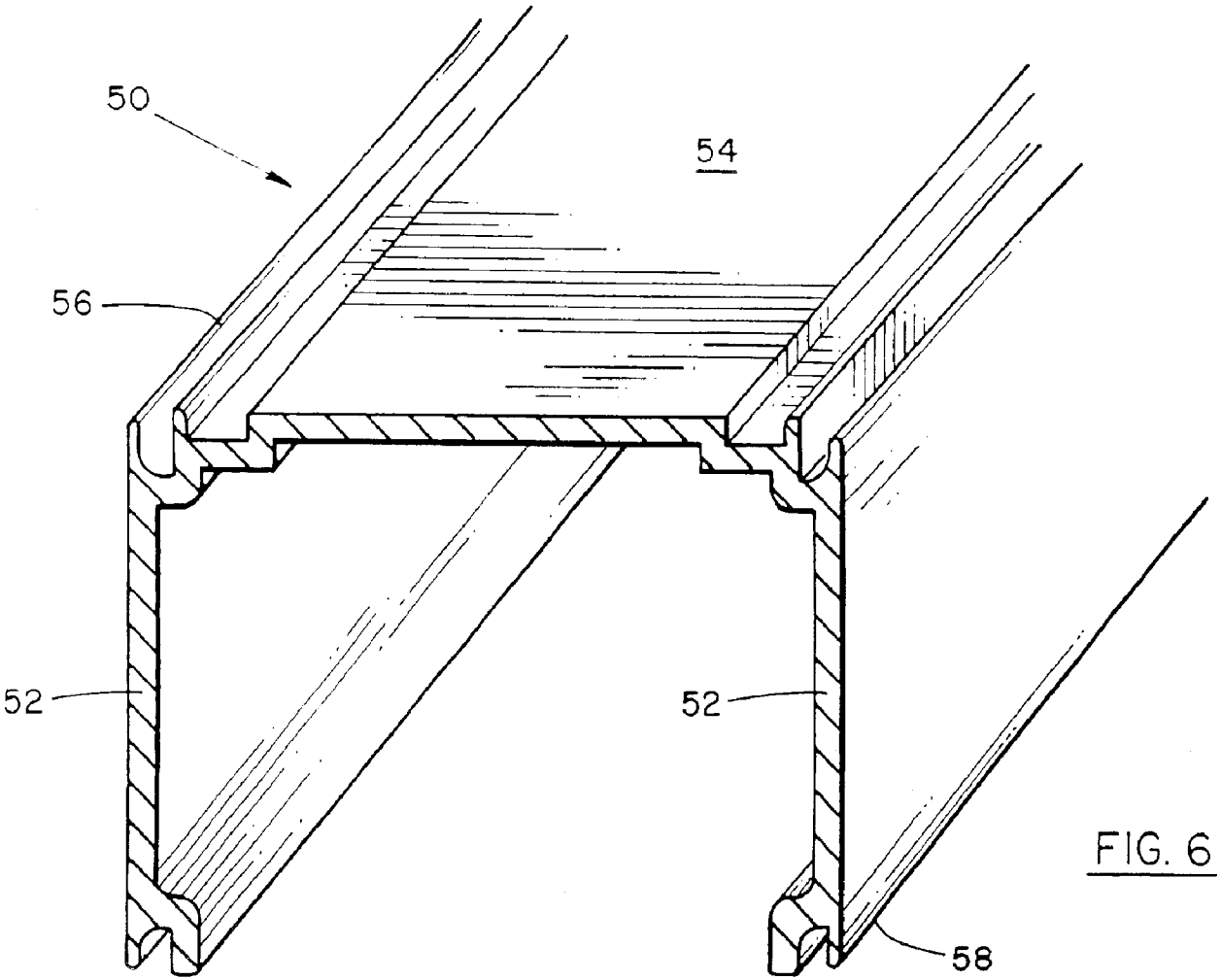
FIG. 6 is a perspective of a portion of FIG. 4.

In this case, additional stiffness at each end of head rail 30 is provided in this embodiment by stiffening plugs 50 (FIGS. 5 and 6).

Stiffening plugs 50 are formed of plastic material, and in this case may be in the shape of an inverted channel, although any other shape providing extra strength and stiffness will be suitable.

Side walls 52 and web 54, are integral, and define a width and height such that they make a sliding fit into the ends of head rail 32. To hold plug 50 secure, upper and lower lips 56 and 58 are arranged to interfit with ridges 44 on head rail 32. When slid into place at each end of head rail 32 the plugs 50 add stiffness to the ends of the head rail and at the same time permit trimming of the head rail, in these ends regions, by a variety of different cutting media, of which the saw cutter is one example, at the same time as trimming the blind slats and bottom rail.

Figure 7:
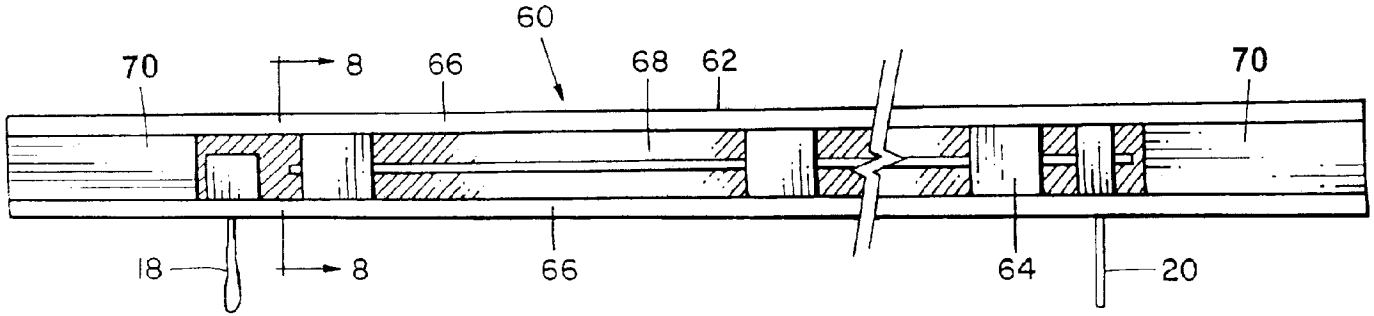
FIG. 7 is a top plan vew of another embodiment of head rail.
Figure 8:
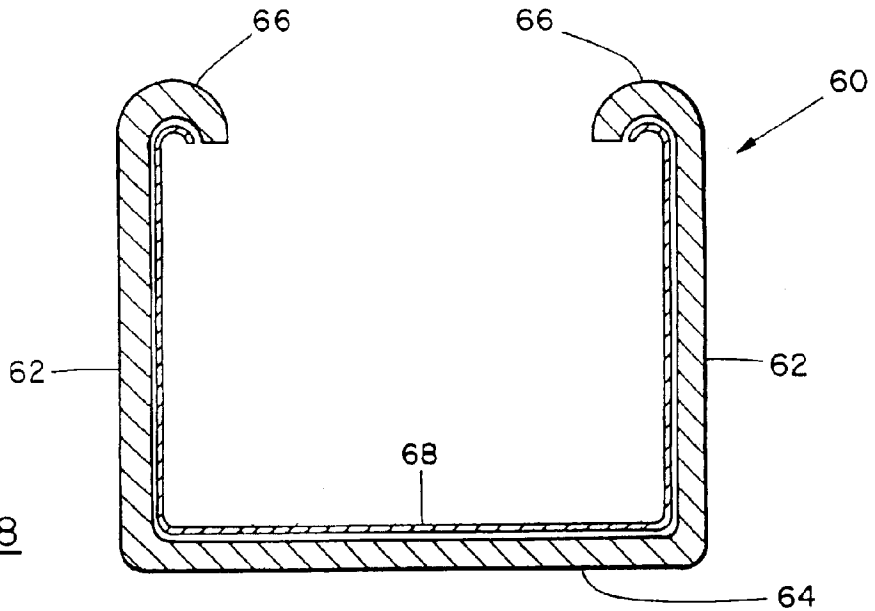
FIG. 8 is a section along line 8—8 of FIG. 7.

Another embodiment of reinforcement is shown in head rail 60 in FIGS. 7 and 8.

In this case the head rail 60 is of substantially regular channel-shaped cross-section, having side walls 62 and a web 64. Rolled edges 66 are formed on the upper free edges of side walls 62. The entire head rail 60, in some cases, or as in this illustration, only a median portion of head rail 60, is reinforced with a metallic three sided channel 68. Channel 68 is dimensioned to make a snug sliding fit within head rail 60. However, as in the FIG. 4 embodiment the reinforcement terminates short of each end of the head rail so as to leave portions at each end of the head rail, which are not reinforced, and are therefor suitable for trimming. Plugs 70, generally similar to plugs 50, will be inserted in each end of head rail 60, where the reinforcement member is absent, so as to permit trimming of each end by a saw. However, if the channel 68 was made of a softer metal, or a non-metal, then it could extend to full length of head rail 60, and in this case the plugs 70 would not be required.

Figure 9:
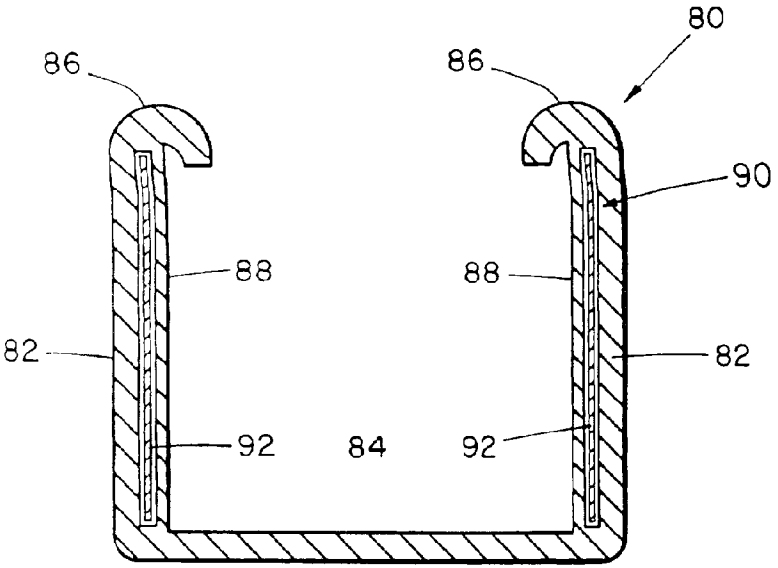
FIG. 9 is a section of a further form of head rail.

A further embodiment is shown in FIG. 9.

In this case, a head rail 80 is formed of extruded plastic material, having a shape in section generally similar to head rail 60, having side walls 82 and a web 84 defining a rectangular U-shaped channel, with rolled edges 86.

However, within side walls 82 there are formed inner passage walls 88 spaced inwardly from side walls 82, which define slim vertical passages 90.

Reinforcement strips 92 of suitable metallic reinforcement material are received in passages 90. In this way the reinforcement strips 92 can be held in position and resist bending stresses imposed on the head rail 80 by the weight of the blind slats. As before the metallic reinforcement, strips may be of softer metal, in which case they can extend the full length of head rail 80, or they may be of harder metal, in which case they would terminate short of each end. In this case some form of additional stiffness (not shown), such as plugs 50 or 70, would be inserted at the ends of the head rail.

Figure 10:
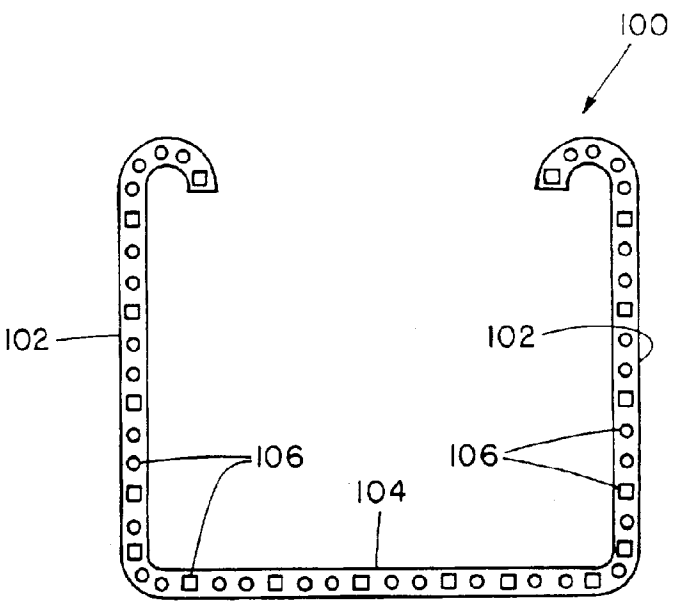
FIG. 10 is a section of a still further form of head rail.

A further embodiment is shown in FIG. 10.

In this case, a head rail 100, has side walls 102 and a web 104, formed of plastic material, and define a rectangular U-shaped channel. In this embodiment reinforcement is provided by a plurality of reinforcement strips or rods 106. Rods 106 would be co-extruded with the plastic material, and would be integrally embedded in the side walls and web as illustrated. The rods could be made of any suitable metal, or of non-metallic material adequate to provide reinforcement for the head rail 100.

In this case, provided the reinforcement material is suitable, the rods could be continued to the ends of the head rail 100. There would then be no need for a plastic plug at each end. The ends could simply be trimmed with a saw, which would cut both the plastic material and the reinforcement rods 106.

Figure 11:
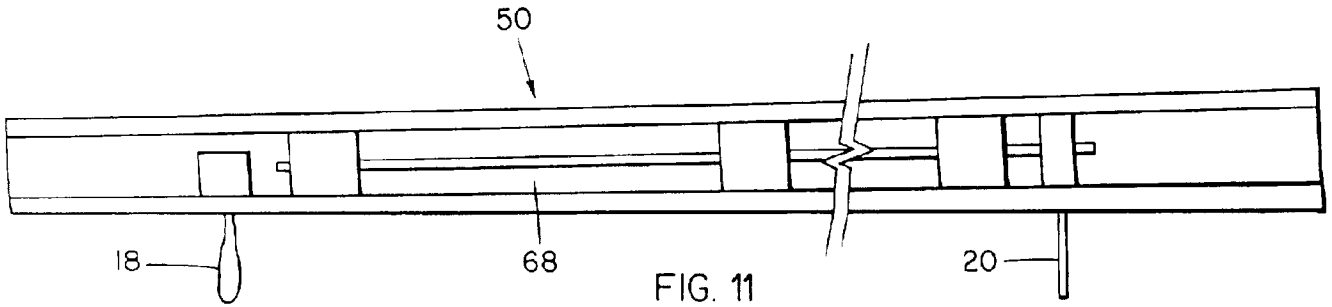
FIG. 11 is a plan view of another form of head rail.

For the sake of completeness, an embodiment of the invention having a metallic reinforcement channel 68 extending from end to end of the head rail is illustrated in FIG. 11.

It will be understood that with suitable selection of reinforcement materials, especially softer metals, or non-metals, any of the embodiments of FIGS. 1 to 9 could all be made with reinforcement extending from end to end, as shown in FIG. 11, provided that the reinforcements were suitable for cutting, by what ever cutting system was available in the store.

Figure 12:
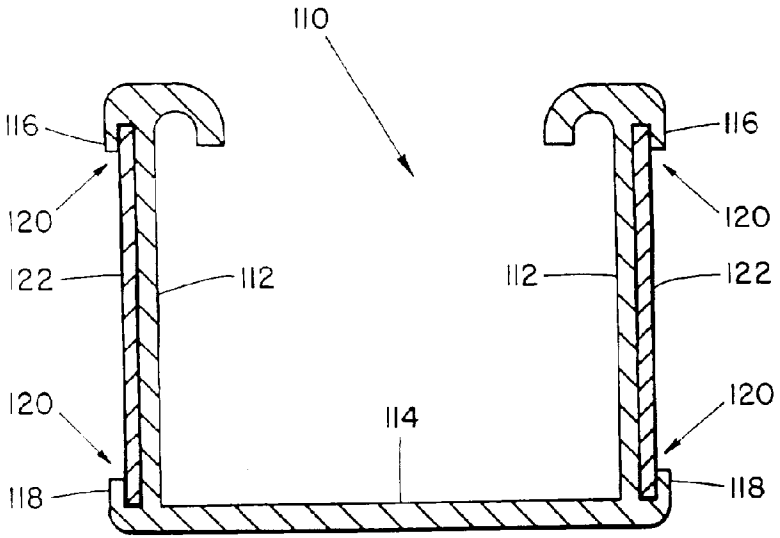
FIG. 12 is a section of a further alternate form of head rail.

A still further embodiment is shown in FIG. 12. In this case the head rail 110 is extruded from thermoplastic material, with side walls 112 and a bottom wall 114.

On the outer sides or side walls 112 upper and lower retaining lips 116 and 118 are formed, defining retention grooves 120. Exterior reinforcement strips 122 are slid into grooves 120, to provide extra bending resistance to the head rail 110.

Strips 122 may be of non-metallic materials, or of metals, either of which being softer, and suitable for cutting in an end trimming apparatus. In this embodiment such reinforcement strips 122 will preferably extend the full length of head rail 110 since the reinforcement strip on at least one side of the head rail 110 will be visible at all times and will in fact present the finished exterior appearance of the head rail 110. In this embodiment this factor may well be an advantage. The exterior facing or finish of the head rail 110 will be the appearance of the reinforcement strip 122.

Since this can be made in a variety of finishes and materials and colours, this embodiment offers great flexibility for stores and for customers.

In all the examples described above, the head rail has been described as a three sided channel. This is in fact the commonest form of such head rail, and is in wide use, both in metal structures as well as in extruded plastics. However it will be understood, that in certain cases, where the head rail is supported with a suitable reinforcement it may be possible to dispense altogether with one of the two channel side walls, of the extruded plastic channel. Thus the plastic head rail would become in effect an L-shaped extrusion with a front wall and a bottom wall, but with no back wall.

Figure 13:
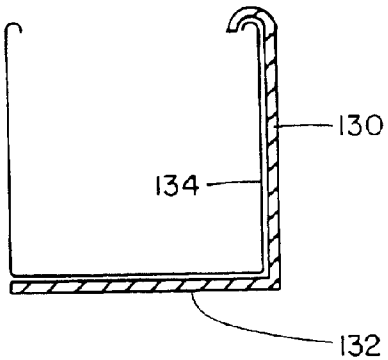
FIG. 13 is a section of a further alternate embodiment of head rail.

Such an embodiment is shown in FIG. 13. The head rail extrusion consists of front wall 130 and bottom wall 132, formed of extruded plastic material.

A reinforcement channel 134 is secured within walls 130 and 132. It may be of softer metal or non metal and extend from end to end, or it may be formed of steel in which case it will terminate short of each end. In this cases some further end members such as plugs 52 of FIGS. 2 and 3 can be used at each end, so as to permit trimming of each end in in store end trim machines.

This may not be suitable for every form of blind, and may not be acceptable to all customers. However for those customers looking for economy and low price, it might have a certain appeal.

Another embodiment of the invention is described in FIGS. 14–17 inclusive.

In this case the head rail 150 is of a substantially regular channel-shaped cross-section, having a web or bottom head rail wall 156 with two spaced upstanding head rail sidewalls 152 and 154 terminating at an upper edge by rolled edges defining ribs 160 and 158 respectively.

The head rail 150 is reinforced with a reinforcement member 170 and dimensioned to make a snug sliding fit in head rail 150.

More particularly the reinforcment member 170 presents a bottom reinforcement wall 176 having two special upstanding reinforcement sidewalls 172 and 174 terminating at the upper edge with rolled edges defining ribs 174 and 180 respectively.

The upper part of head rail 150 and upper part of reinforcement member 170 is open.

Figure 17:
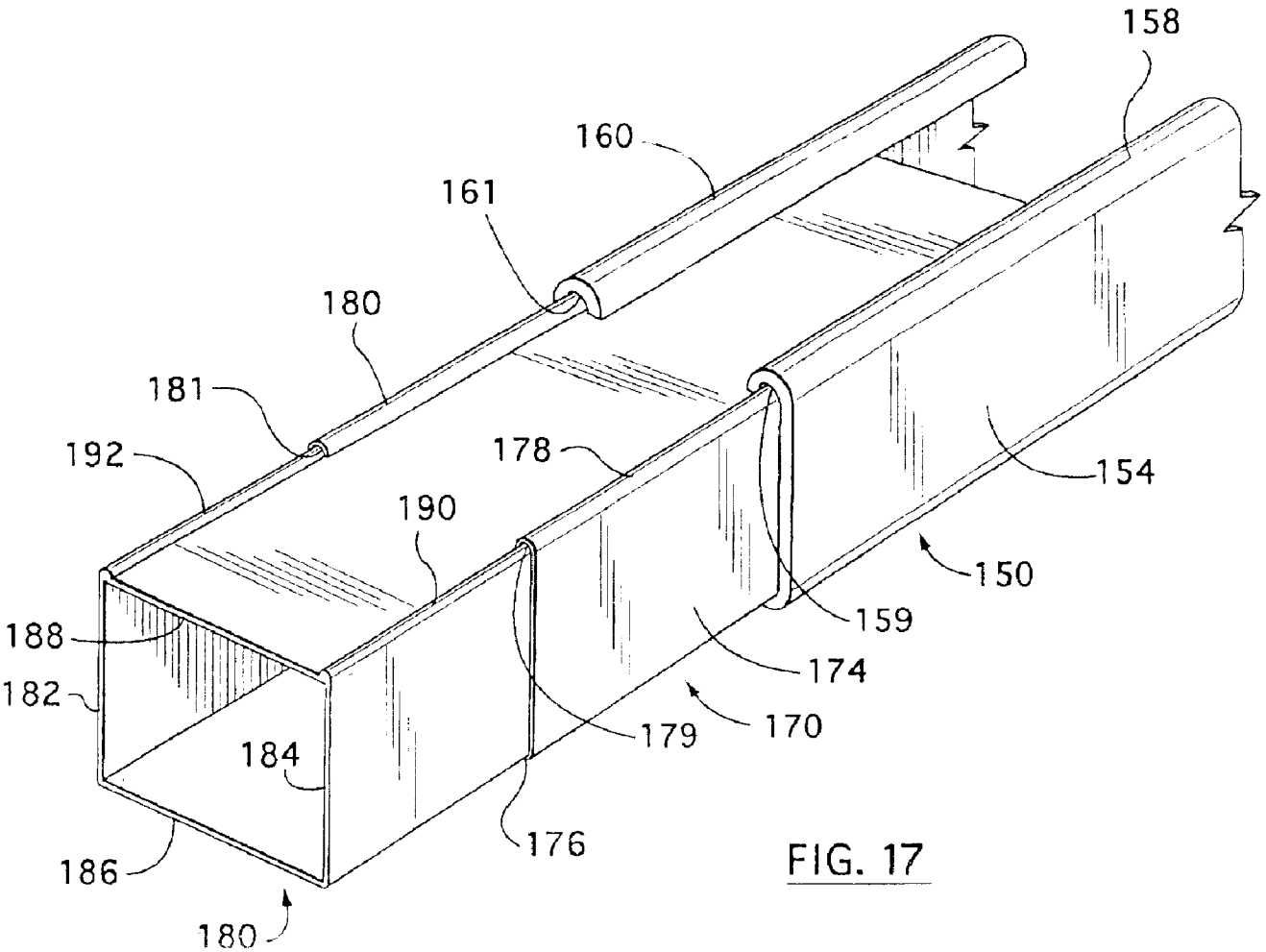
FIG. 17 is a partial expanded view of the head rail of FIG. 14 showing the slideable engagement of the various parts.

The rolled edges or ribs 158 and 160 of head rail 150 define a downwardly extending recess 159 and 161 respectively which is adapted to capture the rolled edges or ribs 178 and 180 of reinforcement member 170 when the reinforcement member is slid longitudinally into the head rail 150 as best illustrated in FIG. 17.

The reinforcement member 170 is sized so that the bottom reinforcement wall 176 abuts the bottom head rail wall 156. Furthermore the upstanding reinforcement sidewalls 172 and 174 abut the upstanding head rail sidewalls 152 and 154 respectfully. Furthermore the rolled edges or ribs 178 and 180 of reinforcement member 170 snugly fit within the recesses 159 and 161 of rolled edges or ribs 158 and 160 respectfully so as to lock the reinforcement member 170 to head rail 150 and inhibit lateral movement of the sidewalls 152, 154, 172, 174.

Furthermore the head rail includes a plug 180 which is adapted to slide into each end of the head rail 150 so as to rigidify the ends of the head rail 150 when the head rail is trimmed to size by the cutting apparatus (not shown).

More specifically the plug means or member 180 is substantially rectangular in cross-section and hollow. The plug 180 includes a bottom plug wall 186 having two spaced upstanding plug sidewalls 182 and 184 and an upper plug wall 188.

The upper plug wall 188 presents two spaced apart projections or lips 190 and 192 which run along the length of the plug 180 as best shown in FIG. 17. The projections 190 and 192 of plug 180 are adapted to be slidingly disposed within the reinforcement member 170. The rolled edges 178 and 180 of reinforcement member 170 define a recess 179 and 181 respectively which are adapted to slidingly receive the projections 190 and 192 respectively.

Figure 14:
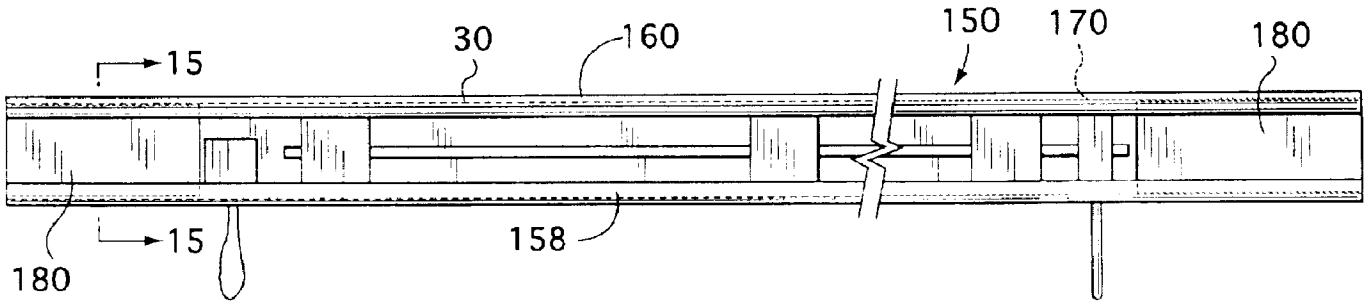
FIG. 14 is a plan view of another form of head rail.
Figure 16:
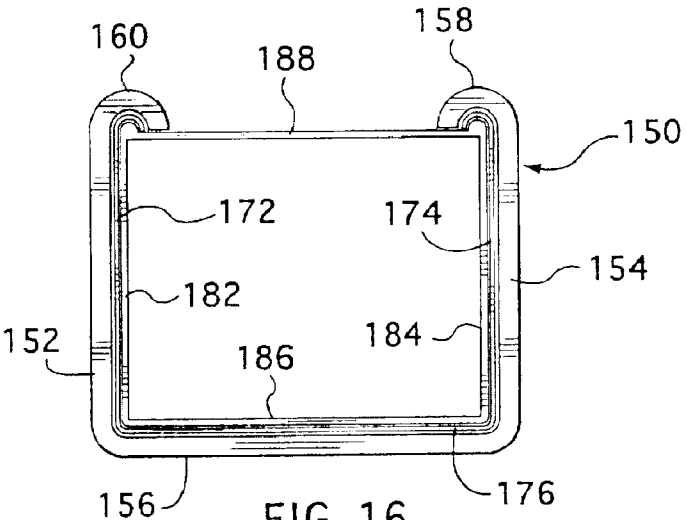
FIG. 16 is an end view of the head rail of FIG. 14.
Figure 15:
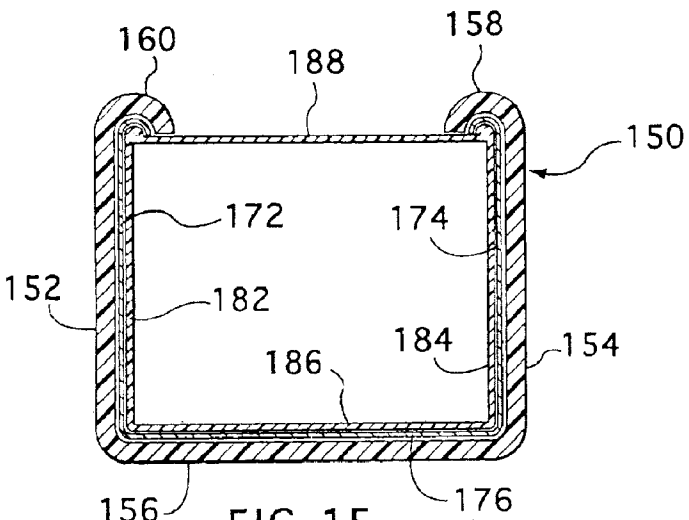
FIG. 15 is a cross-sectional view of the head rail along the lines 15—15 in FIG. 4.

The spacing between the projections 190 and 192 are selected to correspond to the spacing between the rolled edges 178 and 180 of reinforcement member 170 as well as rolled edges 158 and 160 of head rail 150 so that once assembled as shown in FIGS. 14–16 the plug member 180 reinforces, stiffens and inhibits movement of the sidewalls during cutting.

The bottom plug wall 186 abuts the bottom reinforcement wall 176 while the upstanding plug sidewalls 182 and 184 abut the upstanding reinforcement sidewalls 152 and 154 respectively. In this way the plug 180 captures or sandwiches the reinforcement member 170 between the plug 180 and head rail 150 so as to inhibit movement of the reinforcement member when cutting through said head rail, reinforcement member and plug 180; and inhibit lateral movement said vibration of the sidewalls in two directions (i.e. both laterally inwardly and laterally outwardly) to reduce damage when trimming said head rail 150, reinforcement member 170 and plug 180.

FIG. 17 is a slightly expanded view of the plug 180, reinforcement member 170 and head rail 150. When assembled the ends of the plug 180, reinforcement member 170 and head rail 150 will terminate at the same point as shown in FIG. 14. The reinforcement member 170 is of-the same length as the head rail 150 as shown in FIG. 14, while the plug 180 extends a short distance into the ends of the head rail 150 as shown in FIG. 14.

The head rail 150 and plug 180 are generally comprised of a soft material such as plastic or the like while the reinforcement member 170 is of a harder material such as aluminum or the like.

Since the reinforcement member 170 is locked between the plug 180 and head rail 150 the structure will tend to be unified and capable of being cut or trimmed to length by cutting apparatus such as a saw or the like with a minimum of vibration to minimize or inhibit damage to the cut ends of the head rail 150, reinforcement member 170 and plug 180.

Generally speaking the upper wall 188 of plug 180 rigidities or locks the spacing between the rolled edges 158 and 160 of head rail 150, 178 and 180 of reinforcement in two directions of the sidewalls 172 and 174 of the reinforcement member and the sidewalls 152 and 154 of the head rail. A smoother cut or kerf is experienced with a minimal of damage to the cut ends.

Accordingly in order to trim the length of the head rail illustrated in FIGS. 14–16 one measures the space of the window and marks equally the length that needs to be trimmed from the ends of head rail 150. The head rail is then inserted into cutting apparatus (not shown) and the cutting apparatus substantially simultaneously cuts through the head rail 150, reinforcement member 170 and plug 180 so as to produce a smooth cut to the desired size.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An extruded plastic head rail for a blind having a plurality of blind elements suspended from a head rail, head rail being reinforced to prevent sagging of the head rail under a load of the plurality of blind elements, and being suitable for trimming to a predetermined length by a cutting apparatus, the extruded plastic head rail comprising:

(a) a plastic head rail extrusion;

(b) a reinforcement member in the head rail, said reinforcement member capable of being cut by the cutting apparatus;

(c) plug means in the head rail to capture said reinforcement member between the head rail and said plug means and to inhibit movement of said reinforcement member when cutting through the head rail, said reinforcement member and said plug means, wherein said plug means, said reinforcement member, and said plastic head rail extension overlie each other at opposite ends of the head rail.

2. The extruded plastic head rail as claimed in claim 1, wherein the head rail said predetermined length has two opposite ends, and said reinforcement member is of substantially a same length.

3. The extruded plastic head rail as claimed in claim 2, wherein said plug means comprises a plurality of plug members located in each end of said two opposite ends of the head rail, said plug members abutting said reinforcement member, and wherein said plurality of plug members are formed of material softer than said reinforcement member, and wherein the head rail, said reinforcement member and said plurality of plug members are cut together by the cutting apparatus.

4. The extruded plastic head rail as claimed in claim 3, wherein the head rail has a substantially channel-shaped cross-section defining a bottom head rail wall, and two spaced head rail sidewalls terminating at an upper edge.

5. The extruded plastic head rail as claimed in claim 4, wherein said upper edge of each of said two spaced head rail sidewalls is a rolled edge.

6. The extruded plastic head rail as claimed in claim 5, wherein said reinforcement member has a substantially channel-shaped cross-section defining a bottom reinforcement wall, and two spaced reinforcement sidewalls, each reinforcement sidewall of said two spaced reinforcement sidewalls terminating at an upper edge.

7. The extruded plastic head rail as claimed in claim 6, wherein each reinforcement sidewall of said of said two spaced reinforcement sidewalls has a rolled edge.

8. The extruded plastic head rail as claimed in claim 7, wherein said rolled edge of said two spaced reinforcement sidewalls is captured by said rolled edge of said two spaced head rail sidewalls.

9. The extruded plastic head rail as claimed in claim 8, wherein said plug member is substantially rectangular and substantially hollow.

10. The extruded plastic head rail as claimed in claim 9, wherein said plug member has two spaced projections adapted to engage said rolled edge of said two spaced reinforcement sidewalls respectively.

11. An extruded head rail for a blind having a plurality of blind elements suspended from a head rail, the head rail being reinforced to prevent sagging of the head rail under a load of the plurality of blind elements, and being suitable for trimming to a predetermined length by a cutting apparatus, the extruded head rail comprising:

(a) a head rail extrusion extending along the predetermined length and having two opposite ends;

(b) a reinforcement member in the head rail, said reinforcement member capable of being trimmed by the cutting apparatus;

(c) a plug member slidingly disposed in each of the two opposite ends of the head rail to overlap with said reinforcement member and lock said reinforcement member between said plug member and the head rail to inhibit movement of said reinforcement member when the head rail, said reinforcement member and said plug member are cut, wherein said plug member, said reinforcement member, and said head rail extrusion substantially overlie each other at said two opposite ends.

12. The extruded head rail for a blind as claimed in claim 11, wherein said reinforcement member has substantially the same length as the head rail, wherein said reinforcement member is comprised of a material capable of being trimmed by said cutting apparatus, and wherein the head rail and said plug member are comprised of plastic.

13. The extruded head rail as claimed in claim 12, wherein (a) the head rail has a substantially channel-shaped cross-section with (i) a head rail bottom wall; and (ii) two spaced upstanding head rail sidewalls each terminating at a head rail rolled upper edge;

(b) said reinforcement member having a substantially channel-shaped cross-section with (i) a reinforcement bottom wall abutting said head rail bottom wall; (ii) two spaced upstanding reinforcement sidewalls each terminating at a reinforcement rolled upper edge; (iii) each of said two spaced upstanding reinforcement sidewalls abutting each of said two spaced upstanding head rail sidewalls respectively; and (iv) said reinforcement rolled upper edge captured by said head rail rolled upper edge.

14. The extruded head rail as claimed in claim 13, wherein said plug member is substantially rectangular and hollow and has a pair of spaced apart projections, each of said pair of spaced apart projections being slidingly engageable with, and abutting one of said reinforcement rolled upper edge of said two spaced upstanding reinforcement sidewalls to inhibit movement of said two spaced upstanding reinforcement sidewalls and said two spaced upstanding head rail sidewalls during trimming of said head rail, said reinforcement member and said plug member.

15. The extruded head rail as claimed in claim 14, wherein said plug member has a plug bottom wall abutting said reinforcement bottom wall, spaced apart plug sidewalls abutting said two spaced upstanding reinforcement sidewalls respectively, and an upper plug wall presenting said pair of spaced apart projections to capture said reinforcement member between said plug member and the head rail.

16. A plug for an extruded head rail for a blind having a plurality of blind elements suspended from a head rail, the head rail extruded along a length thereof to present two opposite ends, the head rail having a substantially channel-shaped cross-section with a head rail bottom wall, and two spaced head rail upstanding sidewalls, each of the two spaced head rail upstanding sidewalls terminating at an upper edge, the plug comprising:

a plug member disposed for slidable movement in one end of the head rail, said plug member having a bottom plug wall having two upstanding plug sidewalls, and an upper plug wall presenting a pair of spaced apart projections, said upper plug wall extending from one projection to the other of said pair of projections, wherein each of said pair of projections is adapted to engage said upper edge of each of the two spaced head rail upstanding sidewalls to inhibit movement of each of the two spaced head rail upstanding sidewalls when trimming the length of the head rail.

17. The plug as claimed in claim 16, wherein each of the two spaced head rail upstanding sidewalls has a ridge and said pair of projections are slidably engageable with said ridge.

18. The plug as claimed in claim 16, wherein said plug member is rectangular and hollow.

19. The plug as claimed in claim 16, wherein said upper edge is rolled to form a rolled upper edge and said a pair of projections are slidably engageable with said rolled upper edge to inhibit lateral movement of the head rail.

20. The plug as claimed in claim 19, wherein the head rail further comprises a reinforcement member in the head rail, said reinforcement member having:

(a) a substantially channel-shaped cross-section;

(b) a bottom reinforcement wall and two spaced apart reinforcement sidewalls each terminating in a reinforcement rolled upper edge each being engageable with:

(i) said rolled upper edge; and (ii) one of said pair of spaced apart projections to inhibit lateral movement of the head rail, said reinforcement member, and said plug member when trimming the head rail, said reinforcement member and the plug to the length.

21. An extruded plastic head rail for a blind having a plurality of blinds suspended from a head rail, the head rail being reinforced to prevent sagging of the head rail under a load of the plurality of blinds, and being suitable for trimming to a length by a cutting apparatus, the extruded plastic head rail comprising:

(b) a plastic head rail extrusion;

(b) a reinforcement member in the head rail, said reinforcement member capable of being cut by said cutting apparatus; and (c) a plug disposed in the head rail, said plug capturing said reinforcement member between the head rail and said plug and, said plug for inhibiting movement of said reinforcement member when cutting through the head rail, said reinforcement member and said plug, said plug having a wall, said wall having two spaced apart projections, said two spaced apart projections being captured by the head rail and said reinforcement member to inhibit movement of said reinforcement member when cutting through the head rail, said reinforcement member, and said plug, wherein said plug, said reinforcement member and head rail extension substantially overlie one another at said opposite ends of the head rail.

* * * * *